US007375271B1

(12) United States Patent
Zelinsky

(10) Patent No.: US 7,375,271 B1
(45) Date of Patent: May 20, 2008

(54) ENHANCED DRUM STICK

(76) Inventor: Casey Zelinsky, P.O. Box 1055, Twain Harte, CA (US) 95383

( * ) Notice: Subject to any disclaimer, the term of this patent is extended or adjusted under 35 U.S.C. 154(b) by 0 days.

(21) Appl. No.: 11/565,631

(22) Filed: Dec. 1, 2006

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS 5,370,030 A * 12/1994 Horne ..... 84/422.4
6,028,261 A * 2/2000 Johnson ..... 84/422.4
7,173,176 B2 * 2/2007 Nybye ..... 84/422.4

* cited by examiner

*Primary Examiner*—Kim Lockett
(74) *Attorney, Agent, or Firm*—Peninsula IP Group; Douglas A. Chaikin

(57) ABSTRACT

Disclosed herein is an enhanced drum stick. The drum stick includes a grip attachment defining a closed loop which is secured to the drum stick by a bracket. The closed loop can be rigid or relatively flexible.

9 Claims, 3 Drawing Sheets

ENHANCED DRUM STICK

BACKGROUND OF THE INVENTION

Field of the Invention

This invention is related to drum sticks and more particularly to enhanced drum sticks that include attachments to facilitate longer playing with reduced stress and fatigue.

It will be appreciated that drummers undergo substantial amounts of stress while playing the drum. This stress can lead to fatigue and continued playing of the drums can eventually lead to carpal tunnel syndrome. Other drummers develop arthritis from continued drum playing.

Various drum tricks are also desirable for advanced and expert drummers. Such tricks are tiring on the drummers and can cause stress and fatigue leading to the undesirable consequences described above. However, sometimes good and even great performance requires drum tricks.

During a performance or practice, a drummer will perspire. The perspiration will often drip onto their hands. The wetness on their hands makes the drum sticks slippery and clearly it makes drumming difficult and even more stressful and fatiguing.

What is needed is an enhanced drum stick that facilitates the drummer doing drum tricks without overly stressing the drummer. The enhanced drum stick should also provide for greater comfort for regular drumming. Additionally, the enhanced drum stick should provide for easy gripping despite the drummer's wet handle and continued perspiration.

SUMMARY OF THE INVENTION

It is an object of this invention to provide an enhanced drum stick that enables users to play in comfort for extended periods of time.

It is an additional object of this invention to provide such an enhanced drum stick which enables users to perform stick tricks in greater comfort.

It is an additional object of this invention to provide an enhanced drum stick that enables users to play in comfort despite the introduction of perspiration during their performances or practices.

In accordance with the above objects and those that will be mentioned and will become apparent below, the enhanced drum stick in accordance with this invention comprises:

a drumstick having a first end for normally holding the drum and a second end for normally striking the drums; and a grip attachment between the first and second ends, the attachment defining a closed loop and having means for securing the attachment to the drum stick.

In an exemplary embodiment of the drumstick in accordance with this invention, the drum stick closed loop is rigid and made from a metal or engineering plastic. In this embodiment, the user would use the "matched" technique. In the matched technique the hands grip the drum sticks In another exemplary embodiment of the drumstick in accordance with this invention, the drum stick closed loop is relatively flexible and made from a natural or synthetic leather type material. This material has the advantage of resisting loss of grip despite the introduction of perspiration into the drumming environment. With this exemplary embodiment the drummer would typically use more traditional drumming techniques.

In either or both of the above embodiments, the devices the user is served by having an enhanced drum stick which allows a substantially lower stress environment than previously know devices and which additionally allows an expert user to perform "stick tricks" more readily and more comfortably whether during a performance or during practice.

It is an advantage of this invention to a provide a drumstick which enables the user to both enhance his performance and encourage a stress free environment.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
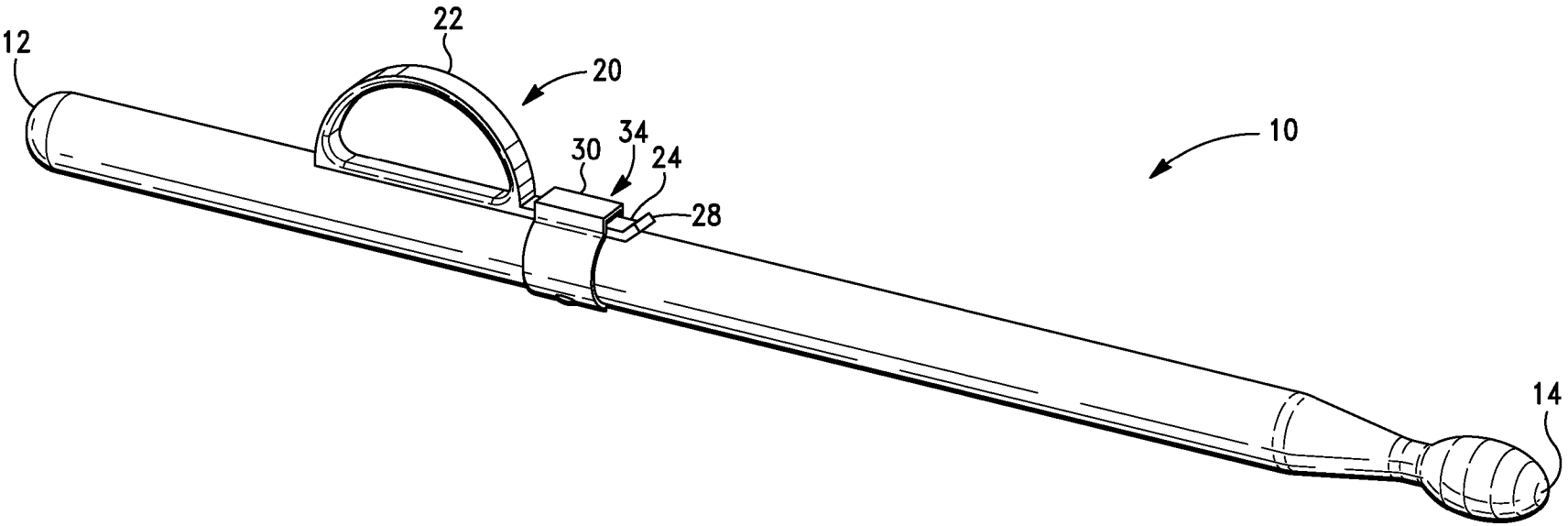
FIG. 1 illustrates, perspective view, an exemplary embodiment of the drum stick in accordance with this invention having a rigid closed loop.

The invention will now be described with respect to FIG. 1, which illustrates an exemplary embodiment of the invention shown generally by the numeral 10, an enhanced drum stick.

The drum stick 10 has a first end 12 and a second end 14. Between the first and second ends, the drum stick includes a grip attachment generally designated by the numeral 20. The grip 20 defines a closed loop 22. In the embodiment depicted in FIGS. 1-5, the closed loop is a rigid closed loop and includes a tongue member 24. The tongue member 24 extends away from the closed loop 22 and has a distal end zone 26 as best seen in FIG. 4.

Figure 4:
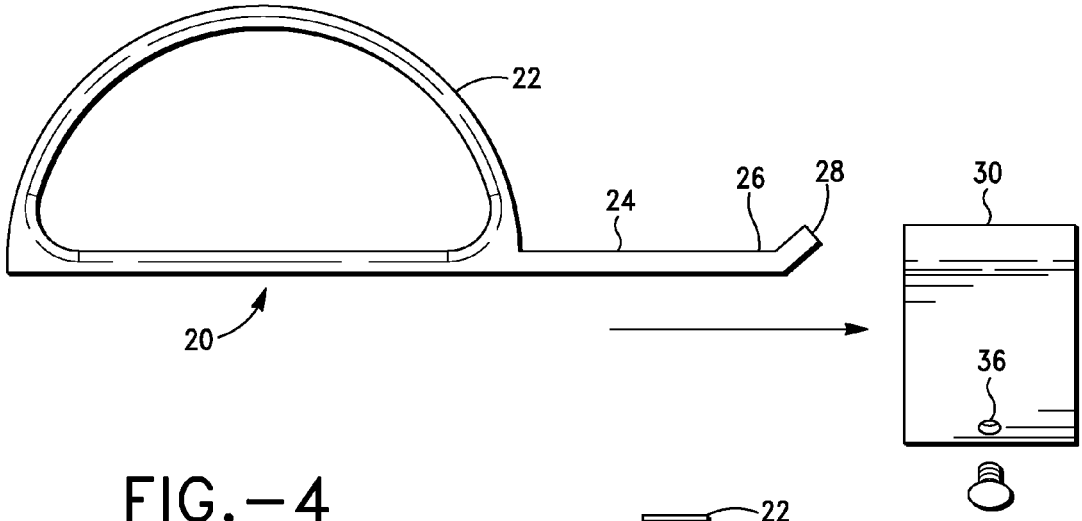

Also as seen best in FIG. 4, the distal end zone 26 has an opposed end 28. The end 28 is turned in opposition to the drum stick 10 surface. So that in attachment, the grip attachment 20 is more readily secured to the drum stick 10. As will be more fully appreciated hereinafter, the opposed end 28 also opposes the bracket.

Figure 2:
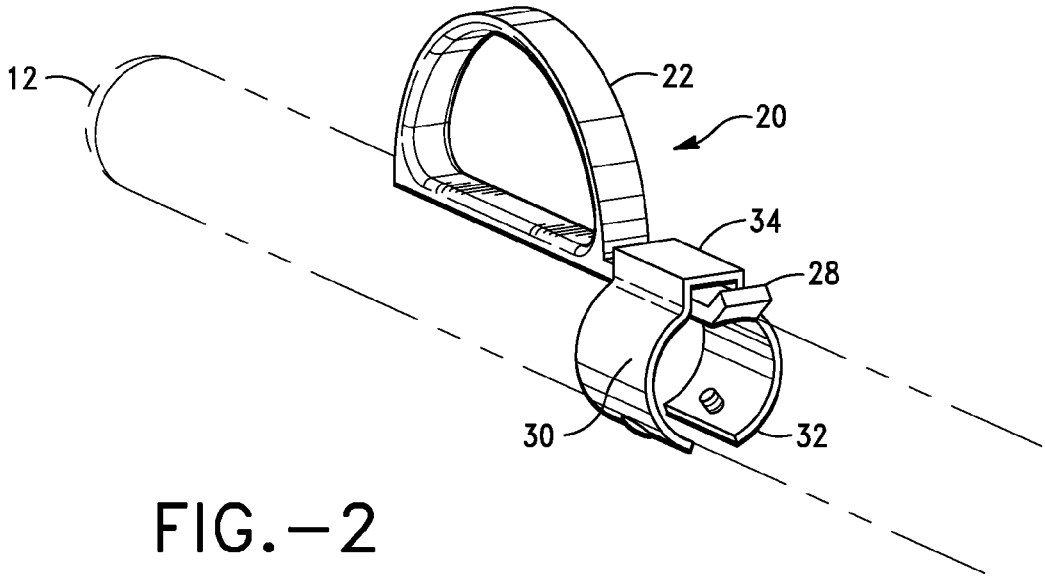
FIGS. 2-4 illustrate the rigid closed loop embodiment of the drum stick in accordance with this invention, shown in perspective view.
Figure 3:
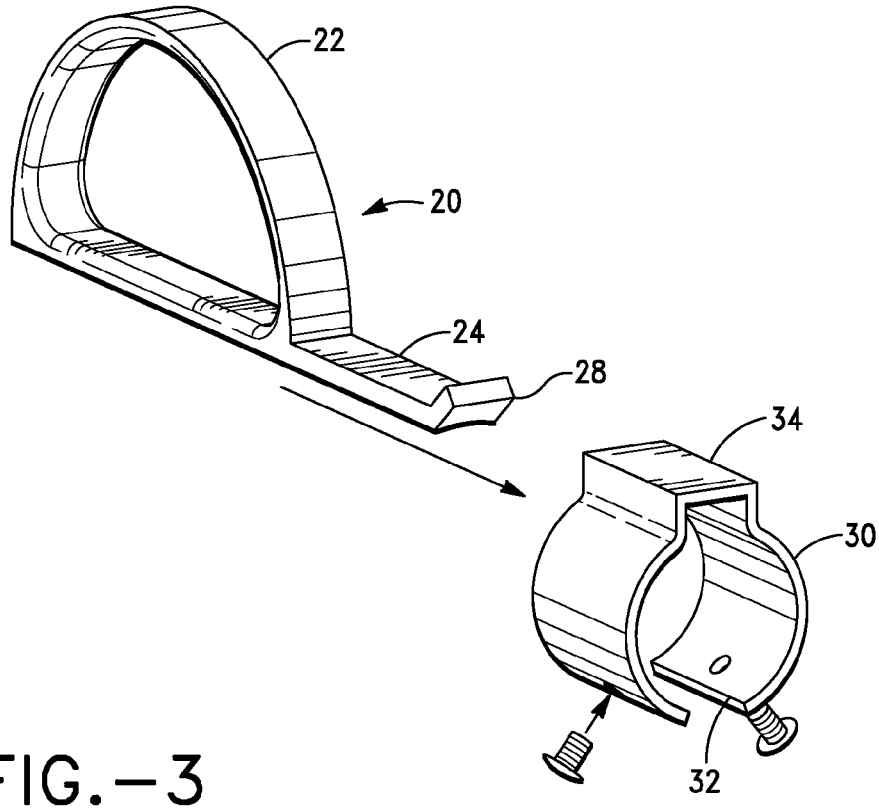
Figure 5:
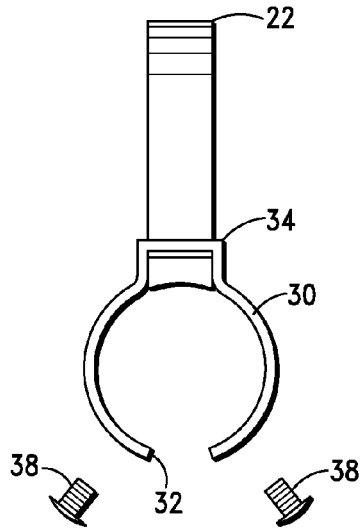
FIG. 5 is an enlarged side of the bracket used to secured the attachment to the enhanced drum stick in accordance with the invention herein.

The grip attachment 20 includes a bracket 30. The bracket 30 is generally circular and has an open end 32, as best seen in FIGS. 2, 3 and 5. The bracket 30 has a notch 34 which is sized and shaped to fit in compatible mating overlaying relationship to the tongue member 24. The bracket 30 has openings 36 which are sized and shaped to allow screws 38 to thread through the openings and secure the grip attachment to the drumstick 10.

Typically, the closed loop 22 is made from a rigid material such as a metal that would be a comfortable fit with the hand of the drummer. Such preferred materials include stainless steel, aluminum or metal from the family of light weight and very sturdy metals. However, the invention is not limited such materials. Other equally satisfactory materials include, for example, engineering plastics and other plastic materials suitable for gripping and playing the drums.

The grip attachment 20 is assembled onto the drumstick 10 by overlaying the attachment 20 onto the drum stick 10.

Next, the bracket 30, notably, the notch portion 34 is in direct overlaying relation to the tongue 24. As noted above, the notch 34 and tongue 24 are designed for compatible, overlaying matable connection.

It is also noted that it is preferable for the bracket 30 to be made from a material having a rigid strength and some spring tension. The bracket 34 is slid over the drum stick 10 and tongue 24 by expanding the circumference of the bracket 34 at the opening 32.

One the compatible overlaying relationship is achieved of the bracket 34 and tongue 24 on the drum stick 10, the screws 38 are threaded through the openings 36. The screws 38 are threaded until they break the surface of the drum stick 10 thus ensuring a secure arrangement of the drumstick 10 and the grip attachment 20.

Figure 6:
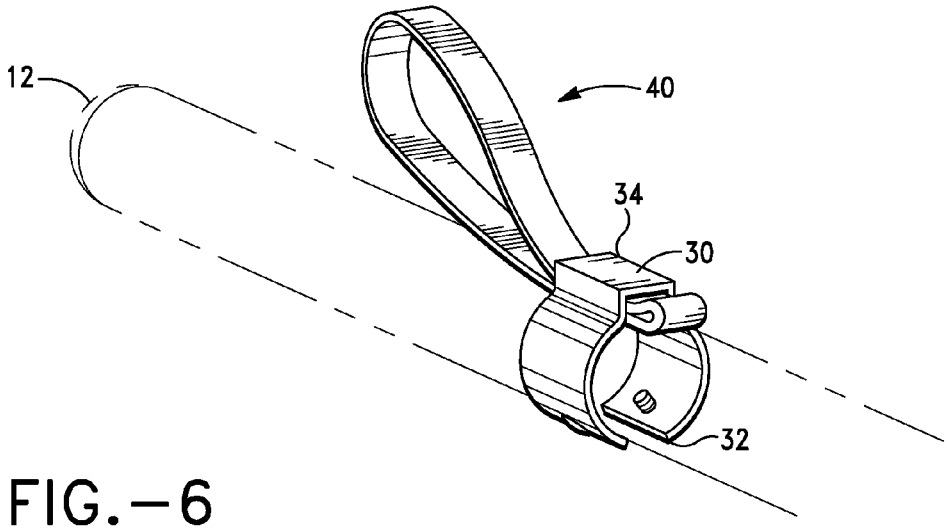
FIG. 6 illustrates, perspective view, another exemplary embodiment of the enhanced drum stick in accordance with this invention having a relatively flexible closed loop.

With respect to FIG. 6, there is shown an alternative exemplary embodiment generally designated by the numeral 40. The attachment in this embodiment similarly includes a closed loop, designated by the numeral 42. The closed loop 42 is made from a relatively flexible material, such a synthetic or natural leather. The bracket 30 in this embodiment is identical to the earlier described embodiment.

However, the method of attachment slightly differs. In this embodiment the closed loop is overlapped upon itself and the overlapped portion is threaded into the notch 34. After that the loop 42 is secured in a similar fashion to that described above with regard to FIGS. 1-4.

While the foregoing detailed description has described several embodiments of the enhanced drum stick in accordance with this invention, it is to be understood that the above description is illustrative only and not limiting of the disclosed invention. It will be appreciated that the embodiments discussed above and the virtually infinite embodiments that are not mentioned could easily be within the scope and spirit of this invention. Thus, enhanced drum stick in accordance with this invention is to be limited only by the claims as set forth below.

What is claimed is:

1. An enhanced drum stick for playing drums, comprising:

a drumstick having a first end for holding the drum and the drumstick having a second end for striking the drums;

a grip attachment between the first and second ends, the attachment defining a closed loop and having means for securing the attachment to the drum stick the closed loop comprises a rigid semi-circular handle, the attachment including a securing bracket sized and shaped to overlap the drumstick and fit matingly over the tongue and the bracket including connectors for removably connecting the bracket to the drum stick; and the handle including a tongue extending from the closed loop and the tongue being removably secured to the drum stick.

2. An enhanced drum stick as set forth in claim 1 wherein, closed loop is semi-circular and relatively rigid and defines a gripping means.

3. An enhanced drum stick as set forth in claim 1 wherein, the handle is made from metal.

4. An enhanced drum stick as set forth in claim 1 wherein, the handle is made from an engineering plastic.

5. An enhanced drum stick as set forth in claim 1 wherein, the bracket defines a pair of openings on either side of the tongue when the bracket is in overlaying relationship to the tongue and wherein the bracket includes screws sized and shaped to fit through the openings and designed to break the surface of the drum stick for removably securing the bracket to the drumstick.

6. An enhanced drum stick as set forth in claim 1 wherein, the tongue include a distal end zone having an opposed end extending away from the drumstick when the attachment is in secured relationship to the drumstick for additionally aiding security of the drum stick and the attachment.

7. An enhanced drum stick as set forth in claim 1 wherein, the bracket has a notch, sized and shaped to fit in mating, overlying relationship to the tongue.

8. An enhanced drum stick as set forth in claim 1 wherein, closed loop is relatively flexible.

9. An enhanced drum stick as set forth in claim 8 wherein, closed loop is made from a material comfortable to the hand such as leather.

* * * * *